US006347418B1

(12) United States Patent
Leib

(10) Patent No.: US 6,347,418 B1
(45) Date of Patent: Feb. 19, 2002

(54) DAYBED WITH PIVOTABLE BACKREST

(75) Inventor: Roger K. Leib, Los Angeles, CA (US)

(73) Assignee: KI-ADD Specialized Support Technology, Inc., Green Bay, WI (US)

( * ) Notice: Subject to any disclaimer, the term of this patent is extended or adjusted under 35 U.S.C. 154(b) by 0 days.

(21) Appl. No.: 09/378,582

(22) Filed: Aug. 20, 1999

(51) Int. Cl.[7] ..... A47C 17/16
(52) U.S. Cl. ..... 5/45; 5/43
(58) Field of Search ..... 5/45, 43, 46.1

(56) References Cited

U.S. PATENT DOCUMENTS

| | | | | | |
|---|---|---|---|---|---|
| 857,315 | A | * | 6/1907 | Starkwather | 5/45 |
| 1,240,500 | A | * | 9/1917 | Sisbower et al. | 5/45 |
| 2,844,828 | A | * | 7/1958 | Stark | 5/45 |
| 3,858,255 | A | * | 1/1975 | Purves, Jr. | 5/45 |
| 4,110,855 | A | * | 9/1978 | Acker | 5/45 |
| 5,787,522 | A | * | 8/1998 | Swihart | 5/45 |

* cited by examiner

*Primary Examiner*—Alexander Grosz
(74) *Attorney, Agent, or Firm*—Boyle, Fredrickson, Newholm, Stein & Gratz, S.C.

(57) ABSTRACT

A convertible daybed including a pivotable swing arm assembly attached between a support for a removable cushion assembly and a backrest assembly. The swing arm assembly includes a pair of brackets attached on either side of the cushion assembly and a pair of swing arms pivotably mounted between brackets at either end of the backrest assembly. The swing arm assembly allows the backrest assembly to be manually moved between a seating configuration, where the backrest assembly is positioned against a rear surface of the cushion assembly, and a sleeping configuration, where the backrest assembly is positioned against the front face of the cushion assembly. The backrest assembly includes a backrest shaped to conform with the front and rear surfaces of the cushion assembly, providing a comfortable seating arrangement in the seating configuration and a substantially flat sleeping surface in the sleeping configuration.

25 Claims, 13 Drawing Sheets

DAYBED WITH PIVOTABLE BACKREST

FIELD OF THE INVENTION

The present invention relates to beds, and more specifically, to a bed that is convertible between a sleeping configuration and a seating configuration.

BACKGROUND OF THE INVENTION

In many residential and institutional settings, it is common to utilize furniture which is capable of performing more than one function due to a limited amount of available living space. For example, in order to conserve space, a bed may also double as sitting furniture such as a couch. In this manner, the need for additional furniture is eliminated such that available space is utilized efficiently while providing all functions required for occupants of the space. A number of dual-purpose articles of furniture have been developed for use in limited space environments. One example is a conventional futon frame which can be positioned in either a seating configuration or a sleeping configuration. The frame supports a cushion which provides a comfortable sleeping or seating surface. In order to move the frame between its sleeping and seating configurations, it is necessary for the user to manually manipulate and reposition the entirety of the frame and the cushion.

Pull-out bed systems are also known, and include a mattress and frame combination adapted for movement to an outward sleeping position relative to a cabinet wall, in which the entire upper surface of the mattress is exposed. In one form, the mattress and frame are moved inwardly to a sitting position such that an inner portion of the mattress and frame are located below a cabinet and an outer portion defines a sitting surface located outwardly of the cabinet. The cabinet doors are typically padded, and form a backrest when the mattress and frame are in the inward sitting position. In another form, the mattress and frame can be slid or pivoted such that the entirety of the bed is stored away when not in use. These systems require the user to move the entirety of the mattress and frame between its inward and outward positions.

It is an object of the present invention to provide a dual purpose article of furniture which can be utilized in either a sleeping configuration or a sitting configuration. It is a further object of the invention to provide such an article of furniture which is well suited for use in a built-in environment. Yet another object of the invention is to provide such an article of furniture in which a minimum amount of effort is required to provide either a sleeping or sitting configuration for the article of furniture. Yet another object of the invention is to provide such an article of furniture which is easily installed in a predetermined amount of space and which is readily suited for retrofit installations. A still further object of the invention is to provide such an article of furniture which is relatively simple in its components and construction, yet which provides highly satisfactory operation as both sitting and sleeping furniture.

SUMMARY OF THE INVENTION

The present invention is a convertible daybed that includes a support, a cushion assembly connected to the support, and a backrest assembly connected to a swing arm assembly that is attached to the support on either side of the cushion assembly. The swing arm assembly is capable of easily and quickly moving the backrest assembly between a seating configuration and a sleeping configuration. The shape of the backrest that forms a part of the backrest assembly allows the backrest assembly to be positioned in either a conventional seating configuration or a substantially flat sleeping configuration with the cushion assembly.

The support may form a top wall of a hollow pedestal that can be used to store items such as sheets and pillows that are used in conjunction with the daybed. The daybed may also include a retractable sheet disposed beneath a rear area of the cushion assembly or elsewhere within the assembly to selectively provide a cover sheet for the daybed then in the sleeping configuration.

The construction of the daybed is simple and easy to assemble and maintain, allowing the daybed to be used in a wide variety of residential and institutional settings.

The swing arm assembly includes a bracket or other pivotable mounting arrangement attached to the support adjacent either end of the cushion assembly and a swing arm pivotably attached between the bracket and the backrest assembly. The swing arm assembly allows the backrest assembly to be moved from a seating configuration in which the backrest assembly is positioned vertically at the back of the cushion assembly to form a backrest, to a sleeping configuration in which the backrest assembly forms a level extension forwardly of the cushion assembly.

The backrest assembly includes a backrest shaped such that the bottom surface of a backrest pad in the assembly can conform to the shape of both the front and rear faces of each cushion forming the cushion assembly. Furthermore, when the backrest assembly is positioned in the sleeping configuration, the rear surface of the backrest lies coplanar with a top face of the cushions providing a substantially flat sleeping surface for the daybed.

The support on which the cushion and swing arm assemblies are mounted may form the top surface of a pedestal that positions the daybed above the floor of a room. The pedestal may have a hollow interior allowing items to be stored inside the pedestal beneath the daybed. To allow access to the interior of the pedestal, the support may be removable from the pedestal by lifting the support off of the pedestal using a handle secured to a front edge of the support. In another form, the pedestal may have an open front, and items may be accessible through doors mounted to the pedestal or within drawers for movement into and out of the interior of the pedestal.

The rearward extensions are removably insertable under retainers affixed to the support and open to receive the extensions. Each cushion frame includes a number of screws integrally attached to the bottom of the frame opposite the extensions that are removably insertable under aligned retainers on the support. The screws are removably fastened to the support by nuts threadably engaged with the ends of each screw protruding through the openings.

To enhance the convenience of the convertible bed when placed in the sleeping configuration, the bed may also include a retractable cover membrane or sheet mechanism located in a channel defined beneath the rear face of the cushion assembly. The cover membrane or sheet mechanism includes a fabric membrane that is connected to a spring retractor mechanism. The membrane or sheet is fastened to the backrest to extend over the bed in the sleeping configuration, and is automatically retracted when the backrest is replaced in the seating configuration.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

The present invention relates to a daybed construction that functions as either a seat or a bed.

Figure 1:
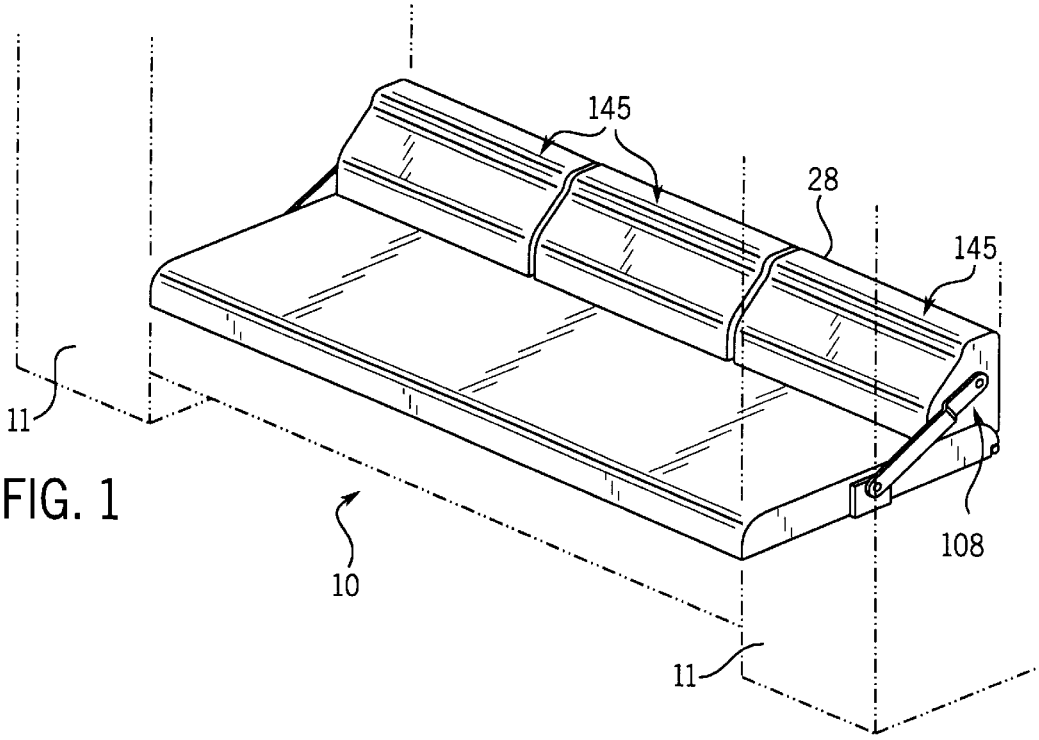
FIG. 1 is an isometric view of a fixed-position version of a convertible daybed with a pivotable backrest constructed according to the present invention, shown in a seating configuration.

Referring to FIG. 1, a convertible daybed 10 is shown in a seating configuration, disposed between a set of cabinets 11 and abutting a rear wall 28. In a manner to be explained, daybed 10 may be converted from the seating configuration shown in FIG. 1 to a sleeping configuration shown in FIG. 2 by shifting a backrest assembly 108 from a seating configuration to a sleeping configuration.

Figure 3:
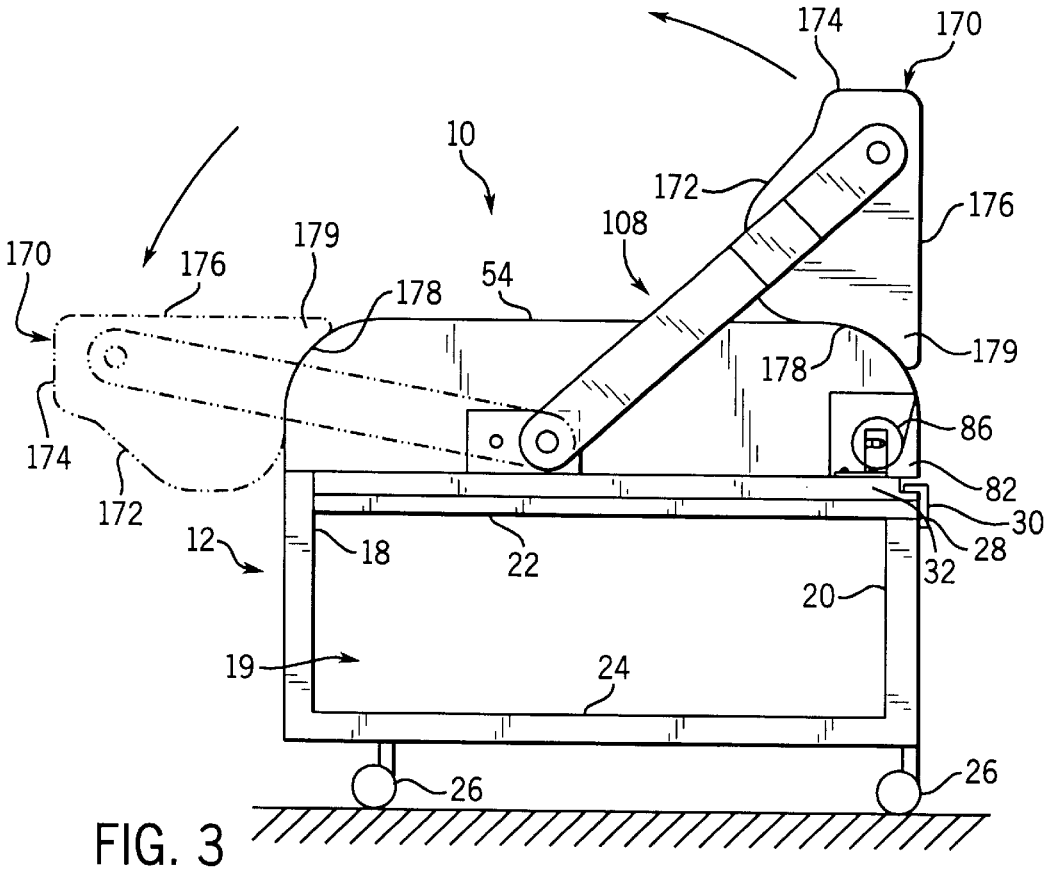
FIG. 3 is an end elevation view of a movable version of a daybed similar to that shown in FIGS. 1 and 2.
Figure 4:
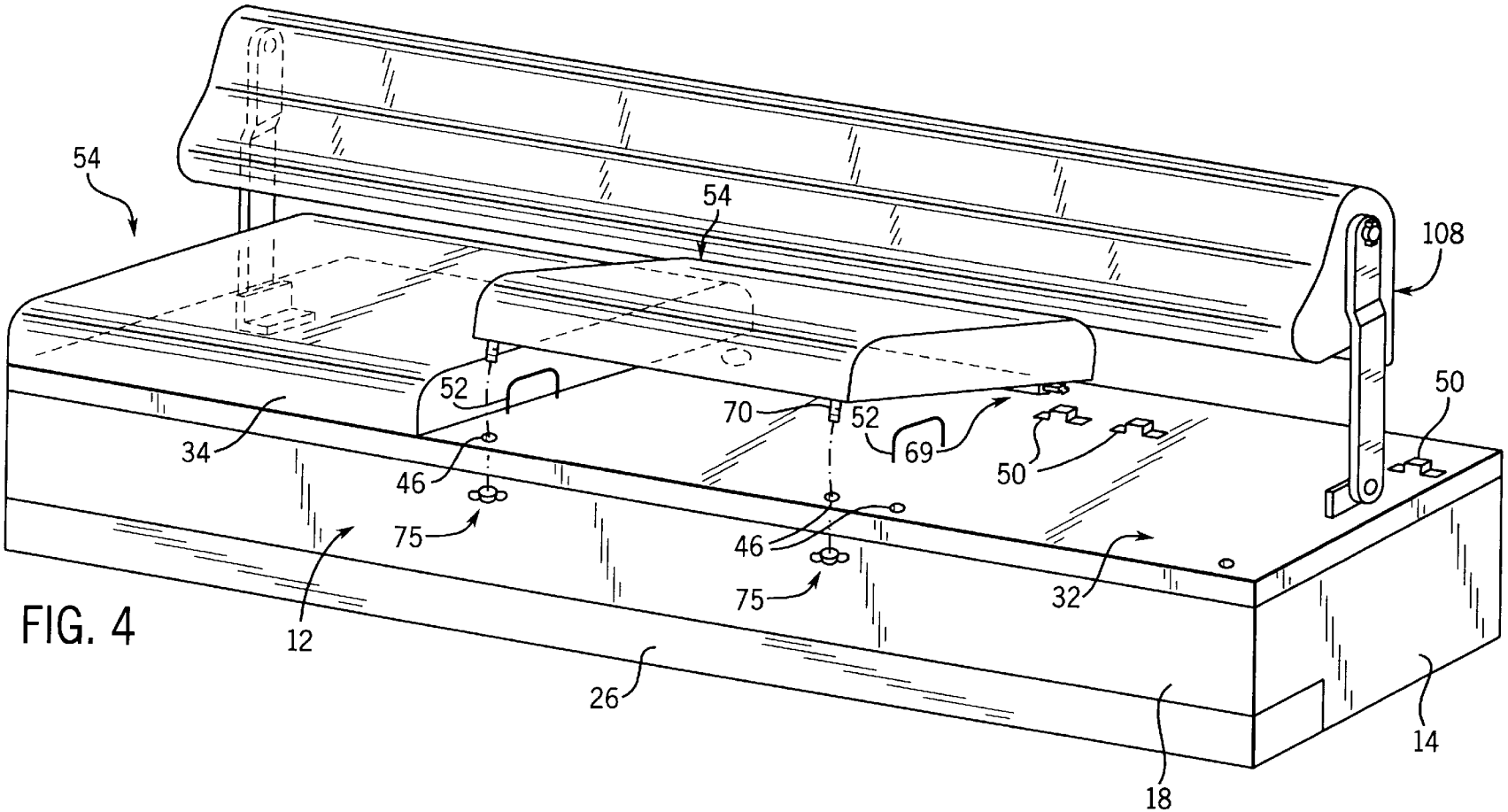
FIG. 4 is an isometric view of the daybed of FIG. 1 showing the support and removability of the cushions.

As shown in FIGS. 3 and 4, daybed 10 is supported by a pedestal 12 which is generally rectangular in shape and supports daybed 10 above a floor surface. Pedestal 12 includes a front panel 18, a rear panel 20 that may abut a rear wall 28 behind daybed 10, a pair of side members 22 extending along the sides of pedestal 12 from the top of rear panel 20 to the side of front panel 18, and a bottom panel 24 extending between front panel 18 and rear panel 20. As side members 22 extend along each of the sides of pedestal 12 perpendicular to front panel 18 and rear panel 20, pedestal 12 defines a storage area 19 which may be utilized to store accessories used with daybed 10 or for storing other articles as desired. The pedestal 12 may be supported by a series of casters 26 (FIG. 3), or may be in the form of a frame supported by a series of legs with depending arms for storage. The sides of pedestal 12 are formed from a pair of side panels 14 attached over the open sides of pedestal 12 and legs 26.

Figure 5:
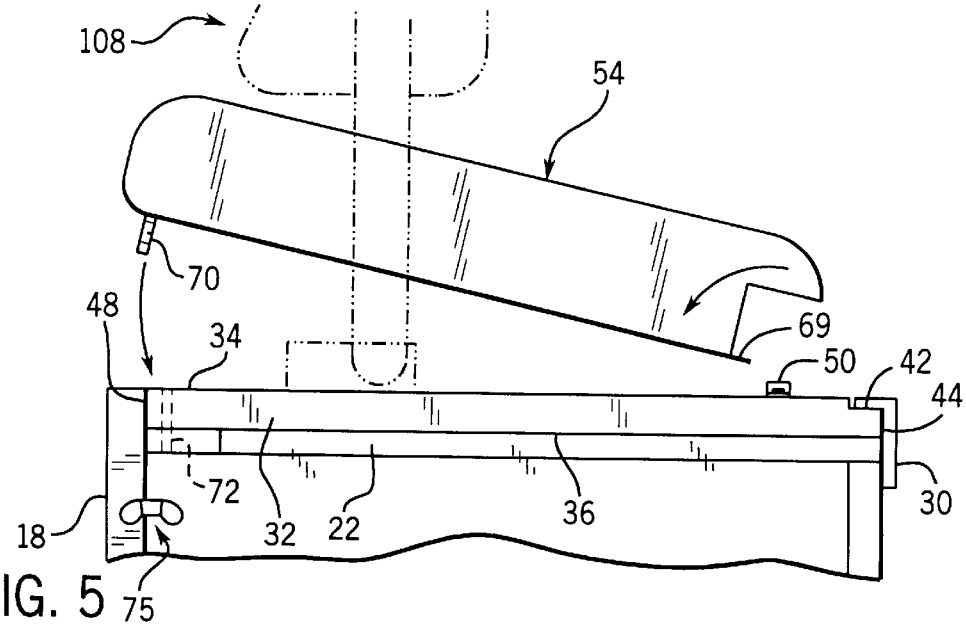
FIG. 5 is a partial end elevation view of the daybed as illustrated in FIG. 4.
Figure 6:
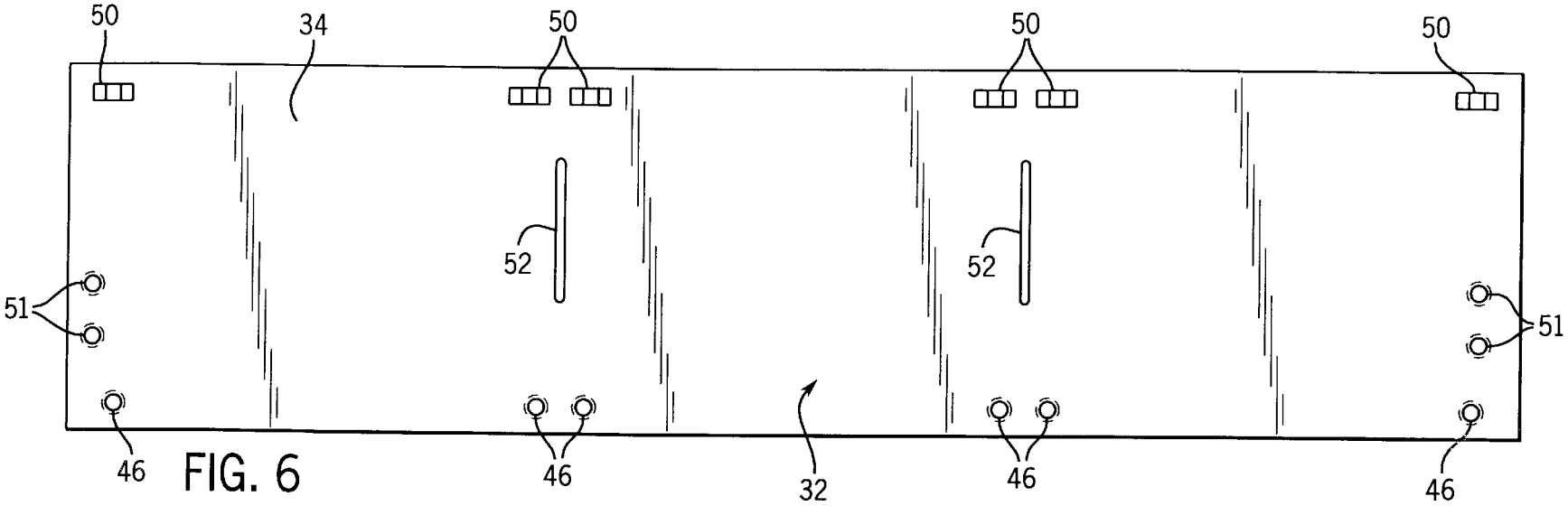
FIG. 6 is a top plan view of the support forming a part of the daybed of FIG. 1.
Figure 6A:
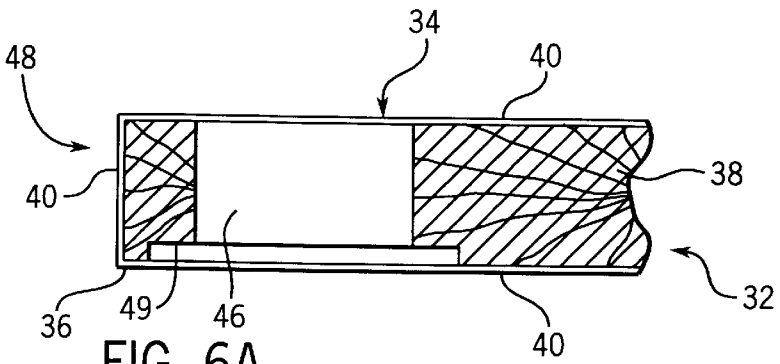
FIG. 6A is a partial cross-sectional view of a cushion mounting aperture in the support of FIG. 6.

Referring to FIGS. 4–6, a hollow steel frame version of daybed 10 is illustrated as including a deck 32 placed over the top of pedestal 12 to enclose pedestal 12 and for mounting a cushion assembly thereto. Deck 32 includes a top surface 34, a bottom surface 36, a rear surface 44 and a front surface 48. As shown in FIG. 6A, deck 32 is formed of an inner core material 38 laminated with a backer board layer 40 over each surface of deck 32. Deck 32 further includes a number of cushion mounting apertures 46, each of which includes a lip 49 disposed adjacent the front surface 48 of deck 32. A series of retainer brackets 50 are mounted to deck 32 adjacent the rear surface of desk 32. A pair of mounting bracket openings 51 are disposed adjacent each side of deck 32, and are located toward front surface 48. Deck 32 is positioned and held against pedestal 12 by a retaining angle 30 attached to rear panel 20 of pedestal 12, that engages a step 42 located in rear surface 44 of deck 32. Also, referring to FIG. 3, as front panel 18 of pedestal 12 extends above side rails 22 and rear panel 20, the top portion of front panel 18 retains deck 32 over pedestal 12. Deck 32 may be removed from pedestal 12 to allow access to cushion frame retainer screws through the use of a pair of handles 52 secured to deck 32 between adjacent cushions of a cushion assembly, that allow a user to pull deck 32 up over the top edge of front panel 18 of pedestal 12 and slide deck 32 off of pedestal 12, moving step 42 out of engagement with retaining strip 30 and allowing deck 32 to be removed from pedestal 12. Deck 32 is mounted over pedestal 12 by reversing this series of steps.

Figure 9:
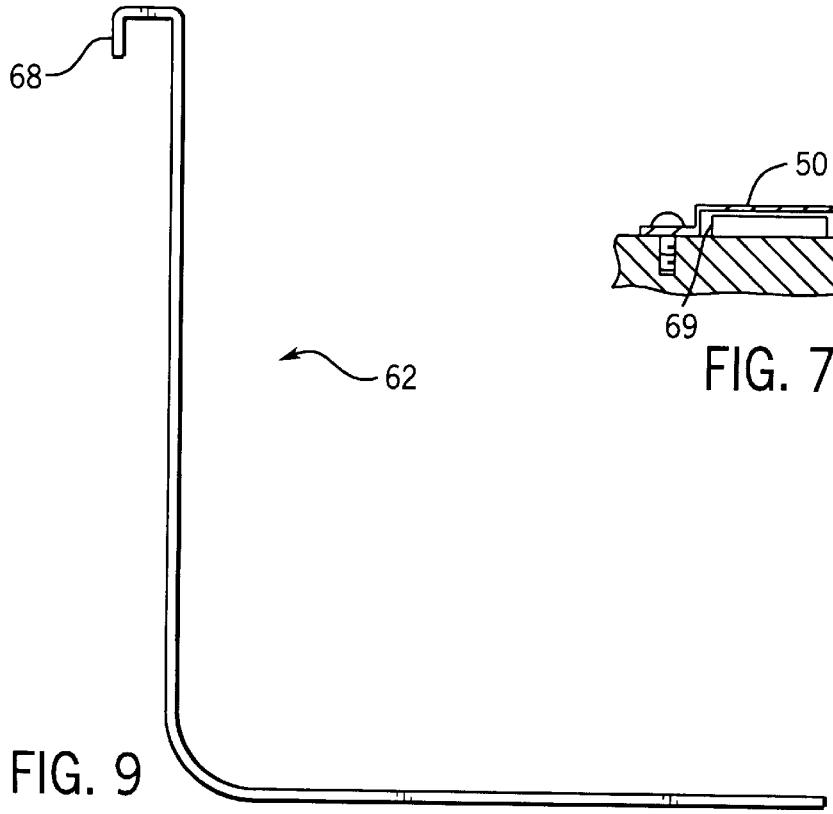
FIG. 9 is an end elevation view of a cover bracket forming a part of the frame of FIG. 7.
Figure 7A:
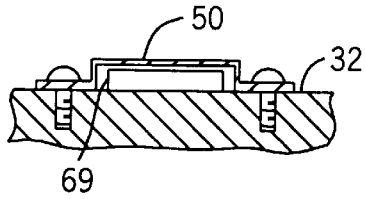
FIG. 7A is a partial section view illustrating retainer arrangement for engaging the cushions with the support member.

FIGS. 4–5 and 7–9 illustrate the construction of the cushion assembly adapted to be attached to deck 32. The cushion assembly is made up of a number of seat cushions 54 that each include a mounting frame 56 that supports a foam pad 74. Each frame 56 includes a front bracket 58, a pair of side brackets 60, and a rear cover bracket 62. Front bracket 58 is a flat metallic piece having a pair of mounting bores 72 located adjacent each end. Each of side brackets 60 is formed of a metallic strip including a raised portion 64 located adjacent one end, and an elevated end 66 opposite raised portion 64 that forms a right angle in side brackets 60. As shown in FIG. 9, rear cover bracket 62 is a generally L-shaped metallic strip that is complementary to elevated end 66 of side brackets 60. Also, rear cover bracket 62 includes a U-shaped locking channel 68 at one end that includes a rounded edge adapted to receive and engage the end of elevated end 66 of side brackets 60 to hold rear cover bracket 62 in engagement with side brackets 60. The rounded edge of locking channel 68 enables a fabric over-cover, which will later be explained, to easily slide past rear cover bracket 62. Front bracket 58, side brackets 60 and rear cover bracket 62 are preferably welded together to form frame 56.

Figure 7:
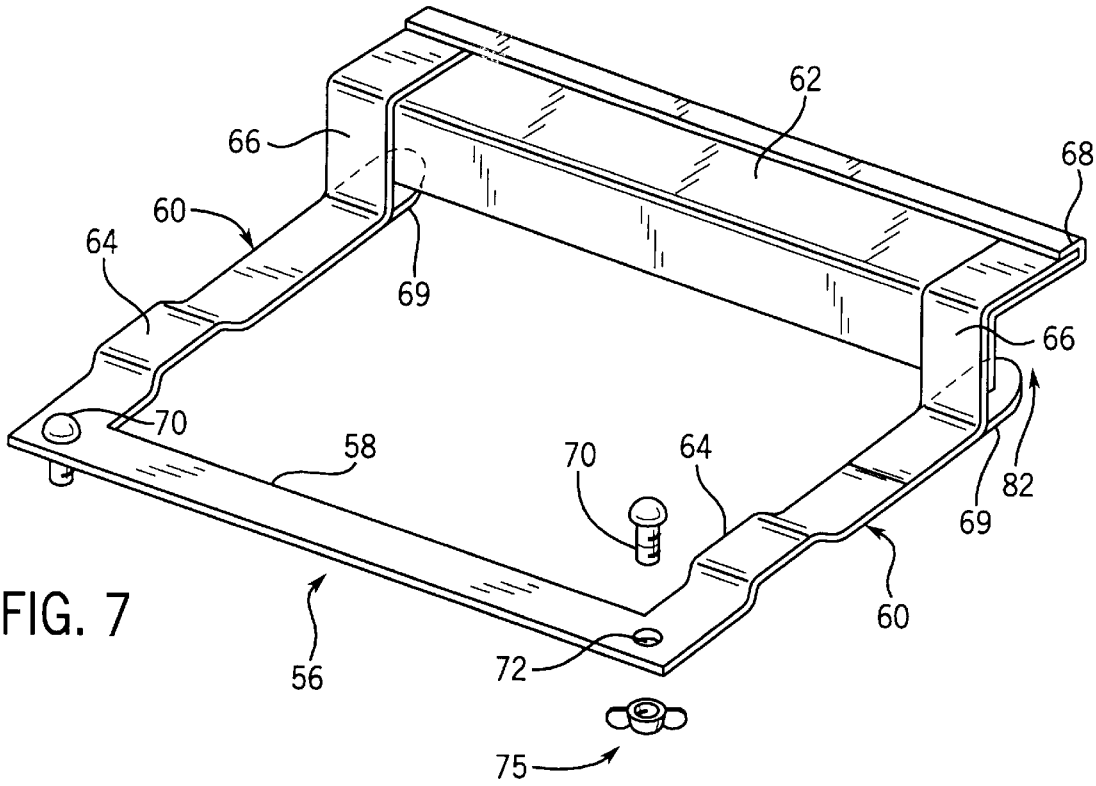
FIG. 7 is an isometric view of a frame of a cushion of the daybed of FIG. 1.

Frame 56 also includes a pair of threaded screws 70 inserted through mounting bores 72 and secured by wing nuts 75, and a pair of mounting tabs 69 used to secure the frame 56 to the platform 32 by engagement with retainers 50. With side brackets 60 constructed as shown in FIG. 7, each mounting tab 69 is located slightly forwardly of elevated end 66.

Each mounting tab 69 is inserted into a space defined by retainer 50 so that tab 69 underlies retainer 50 to prevent the cushion 54 from being lifted off of deck 32. The front end of the cushion 54 is then lowered so that the pair of threaded screws 70 which extend through screw bores 72 in the corners of front bracket 58, are inserted through front apertures 46 in deck 32. The cushion 54 is removably secured on deck 32 through the engagement of circular foot 73 with the lip 49 of rear aperture 50 and by wing nuts 75 threadedly mounted onto threaded screws 70 and engaged with the bottom surface 36 of deck 32.

It should be understood that the seat cushion assembly shown and described is but one satisfactory way to secure the seat cushions 54 to deck 32, and that other removable mounting systems could be employed.

Figure 8A:
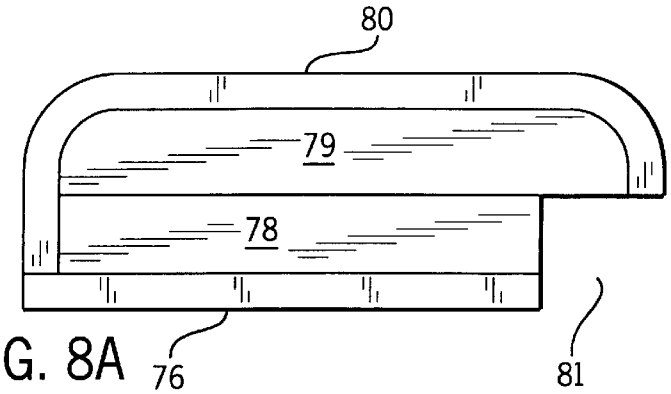
FIG. 8A is a side elevation view of the cushion of FIG. 8.
Figure 8:
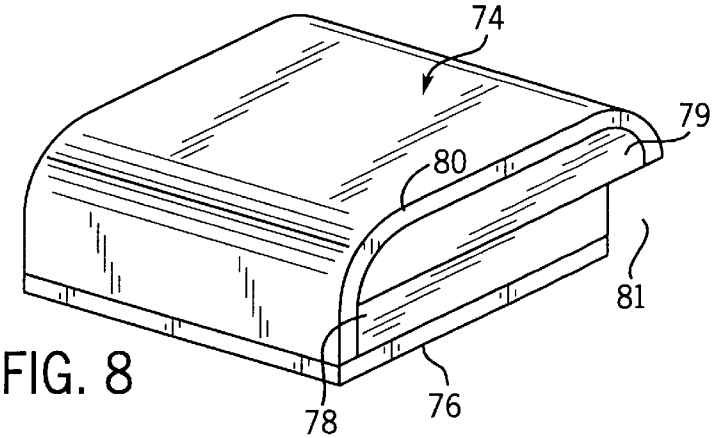
FIG. 8 is an isometric view of a cushion of the daybed of FIG. 1.
Figure 8C:
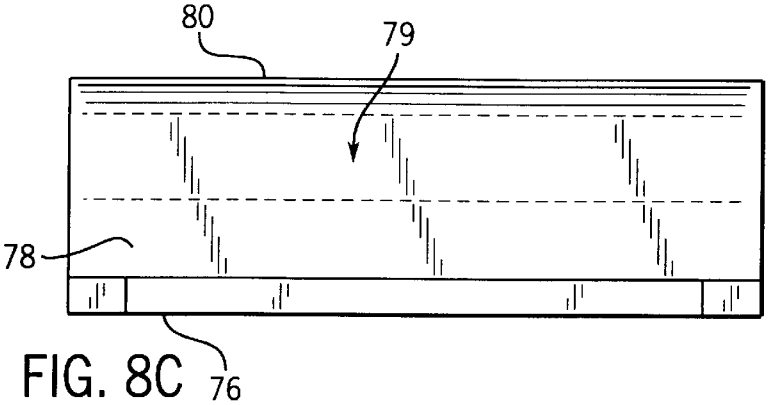
FIG. 8C is a front elevation view of the cushion of FIG. 8.
Figure 8B:
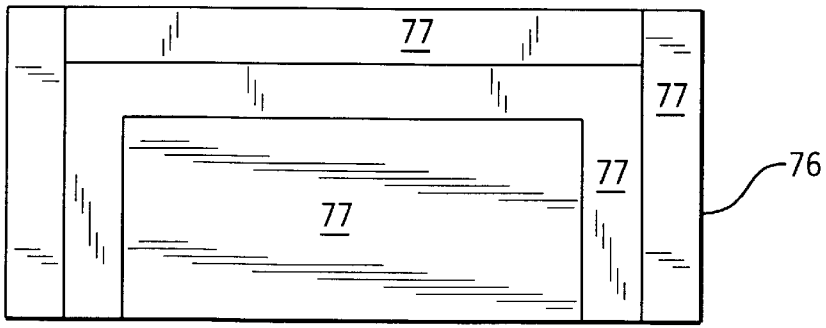
FIG. 8B is a bottom plan view of the base of the cushion of FIG. 8.

The foam pad 74 of cushion 54 is shown in FIGS. 8–8C. The foam pad 74 consists of a base layer 76 formed of a resilient material supporting a lower foam cushion layer 78 and an upper foam cushion layer 79. The foam cushion layers 78 and 79 are covered by a cover 80 that forms the top of the foam pad 74. Velcro strips (not shown) are affixed along the inside edges of frame 56 and are adapted to mate with complementary Velcro strips (not shown) located on securing flaps (not shown) on cover 80 to secure cover 80 to the underside of frame 56. As seen in FIG. 8B, base layer 76 is comprised of foam strips 77 that are made of a very firm flexible foam. Base layer 76 and lower foam cushion layer 78 have a length less than upper foam cushion layer 79 and cover 80 to form a cut out 81. Cut out 81 allows foam pad 74 of cushion 54 to form a square channel 82 above the pedestal 12 and to enclose the arrangement of the rear cover bracket 62 and elevated ends 66 of side brackets 60 along the rear of the cushions 54 when frame 56 and foam pad 74 are assembled and attached to deck 32 in the manner of FIG. 3.

Figure 2:
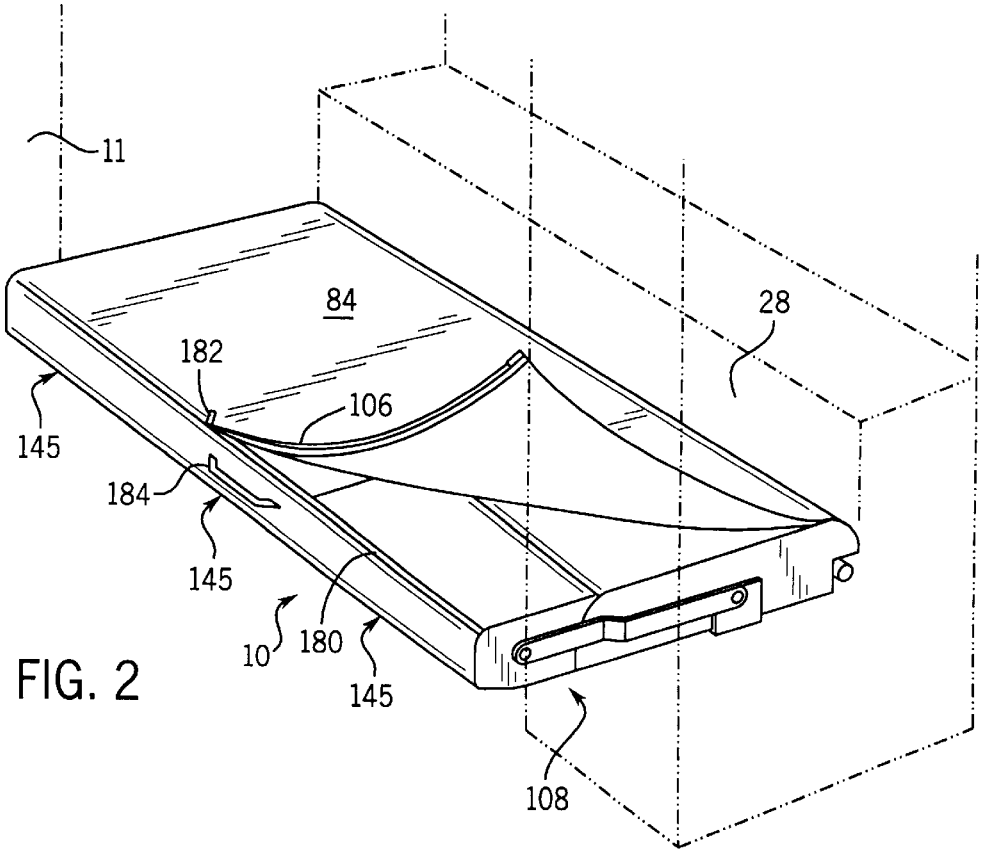
FIG. 2 is an isometric view of the daybed of FIG. 1 shown in the sleeping configuration.
Figure 10:
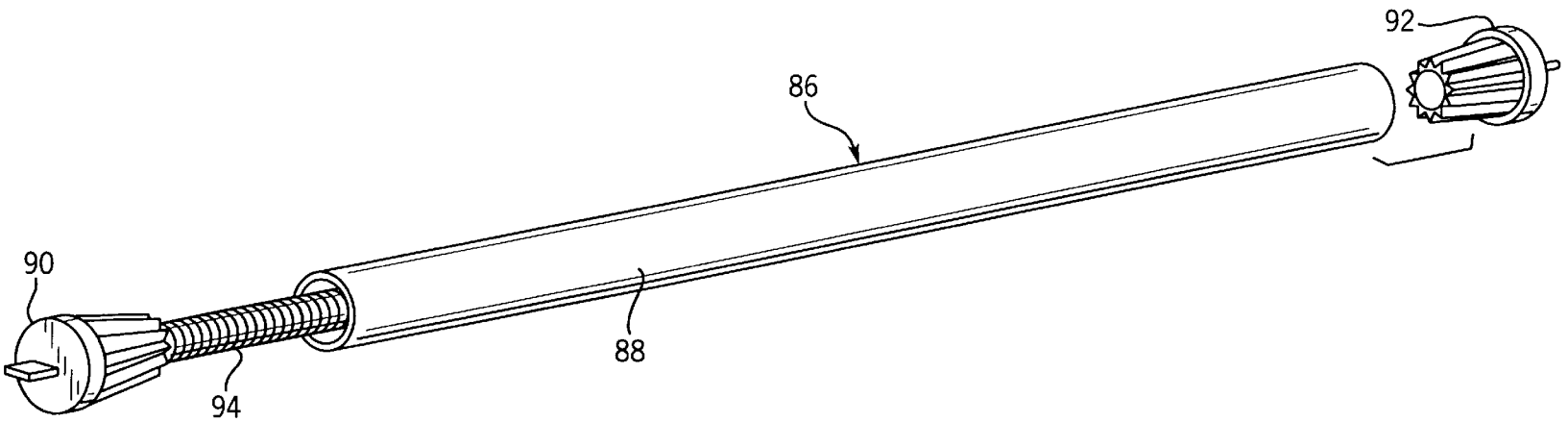
FIG. 10 is a partially exploded isometric view of a retractor mechanism incorporated into the daybed of FIG. 1.
Figure 11:
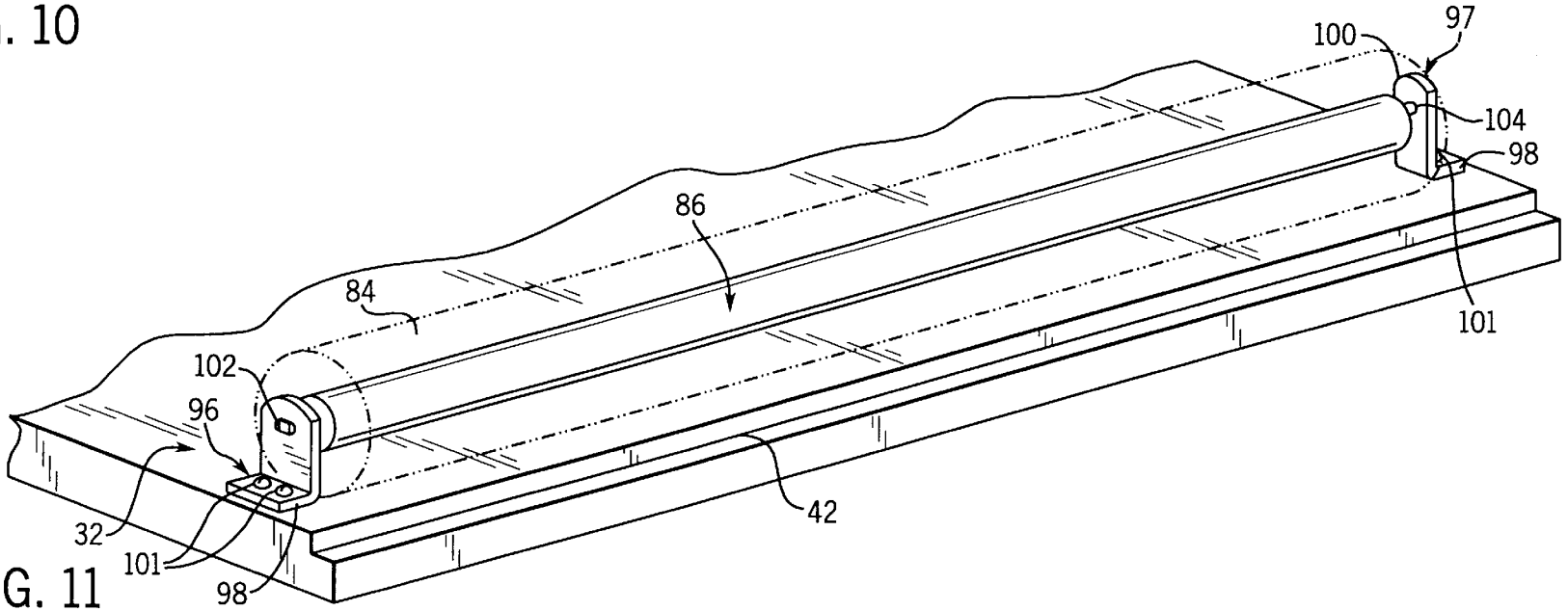
FIG. 11 is an isometric view of the retractor mechanism of FIG. 10 attached to the support of the daybed of FIG. 1.

The square channel 82 encloses a retractor mechanism 86 to which a bed cover 84 is connected for use when the daybed 10 is in the sleeping configuration shown in FIG. 2. As shown in FIGS. 10–11, the retractor mechanism 86 includes a tube 88 that encloses a rewind spring 94. The rewind spring 94 is held within the tube 88 by a tab adaptor 90 engaged within one end of tube 88, and a pin adaptor 92 is pressed into the opposite end of tube 88. The retractor mechanism 86 is connected to deck 32 adjacent step 42 on the rear surface 44 of deck 32 by a pair of brackets 96 and 97 attached to deck 32. Brackets 96 and 97 each have a flat mounting portion 98 including screw openings into which are threaded screws 101 to secure the brackets 96 and 97 to deck 32. Each bracket 96 and 97 also has an upwardly extending retractor mounting portion 100 that is used to engage and hold retractor mechanism 86 between brackets 96 and 97. Each bracket 96 and 97 may alternatively include a mounting flange (not shown) extending from bracket 96 or 97 opposite mounting portion 100, to secure bracket 96 or 97 to a side of deck 32. Bracket 96 has a pin opening 104 near the top of retractor mounting portion 100 adapted to receive the pin adaptor 92 of retractor mechanism 86. Similarly, bracket 97 has a tab slot 102 adapted to receive the tab adaptor 90 of retractor mechanism 86. Retainer mechanism 86 and tube 88 may also enclose rewind spring 94 and be secured to deck 32 by a pair of tab adaptors 90 engaged in either end of tube 88. In such an arrangement, tube 88 is secured to deck 32 by a pair of brackets 97 including tab slots 102 that receive tab adaptors 90 extending from either end of tube 88.

Figure 12A:
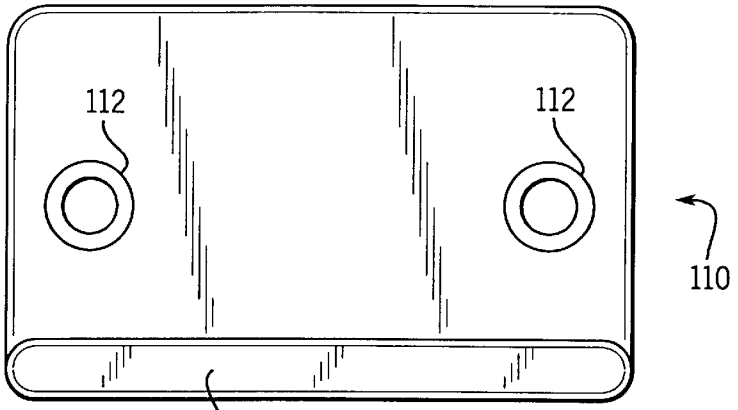
FIG. 12A is a top plan view of one of the mounting brackets of FIG. 12.
Figure 12B:
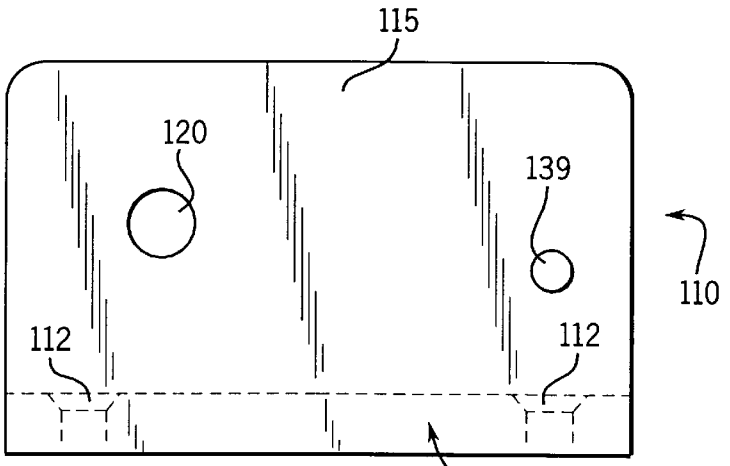
FIG. 12B is a front elevation view of one of the mounting brackets of FIG. 12.
Figure 12:
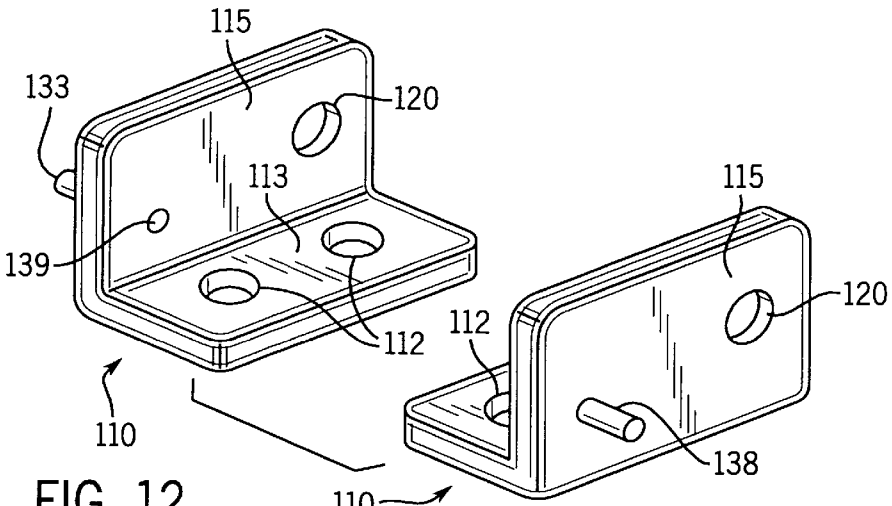
FIG. 12 is an isometric view of a pair of facing mounting brackets for the swing arm assembly of the daybed of FIG. 1.

Referring now to FIGS. 12–15C, daybed 10 is shown as including a pivotable backrest assembly 108 which is attached to deck 32 by a pair of L-shaped facing brackets 110 secured on deck 32 on either side of the cushions 54. Each bracket 110 includes a pair of bracket mounting openings 112 located on the lower portion 113 of bracket 110 as shown in FIGS. 12–12B. A pair of screws 114 are inserted through bracket mounting openings 112 into openings 51 in deck 32, each of which receives a coupling member 116 having a passage through which the shank of one of screws 114 extends. A lock nut 118 is threadably engaged with each screw 114 to thereby securely mount each bracket 110 to deck 32. In this position, lower portion 113 of bracket 110 is positioned beneath raised portion 64 of side bracket 60 of frame 56 when the cushions 54 are attached to deck 32.

Each bracket 110 also includes an upper portion 115 provided with a swing arm opening 120. A swing arm 122, which includes an upper arm portion 124 and a lower arm portion 126 joined by an angled bend 128, is secured at its lower end by an internally threaded stud 132 inserted through a mounting opening 130 in lower arm portion 126 and tack welded thereto to prevent rotation of stud 132 relative to arm 122. Low-friction washers 134 are disposed on either side of opening 120 in bracket 110 when stud 132 is inserted through swing arm opening 120. Swing arm 122 is pivotably secured to bracket 110 by a screw 136 threadably engaged within the threaded internal passage defined by stud 132.

A stop pin 138 is located on upper portion 115 of each bracket 110, extending outwardly from a stop pin opening 139 in upper portion 115 of bracket 110. Stop pin 138 is operable to limit the pivoting movement of swing arm 122, in a manner to be explained.

Figure 14:
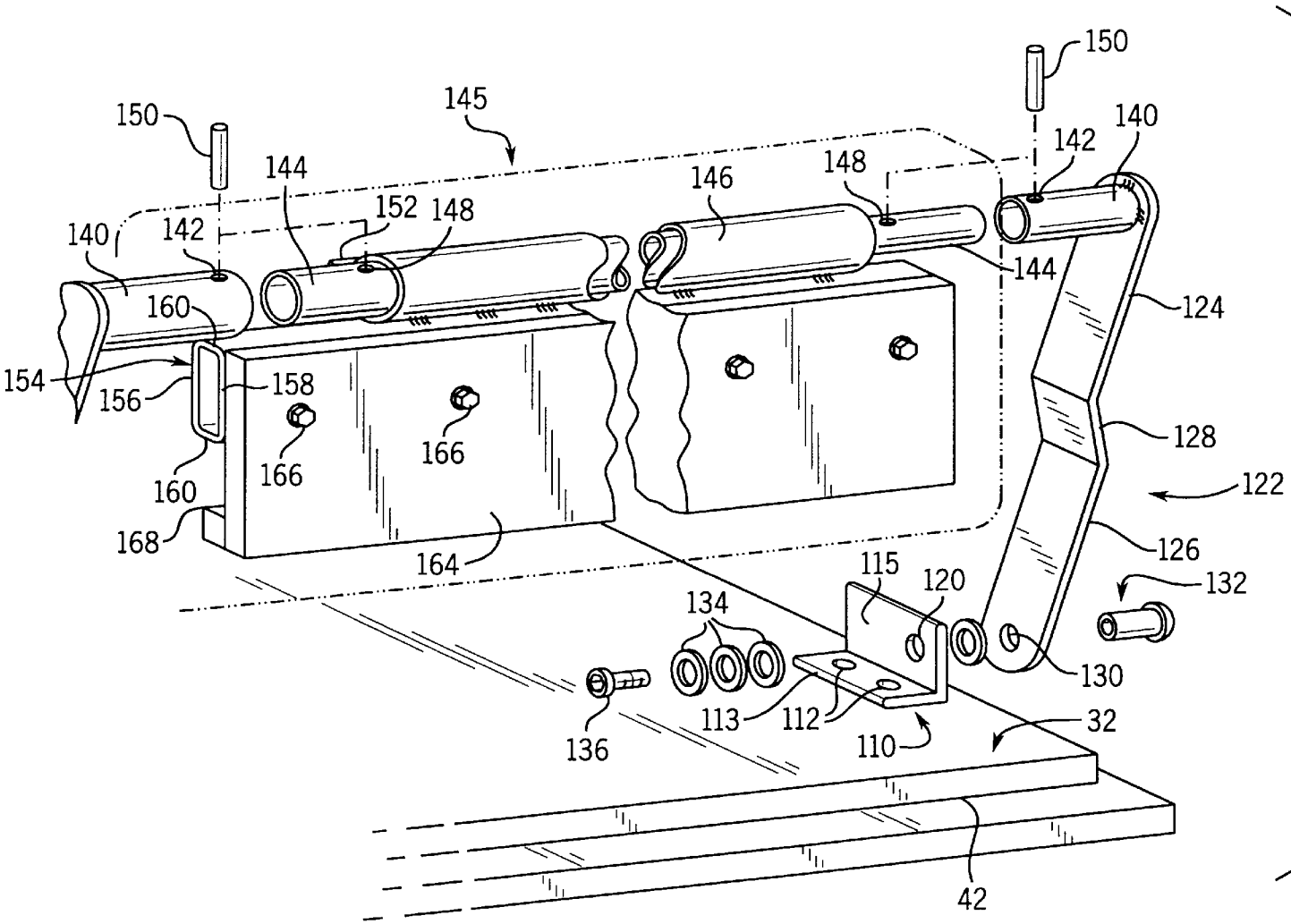
FIG. 14 is a partial exploded isometric view of the backrest assembly and the swing arm assembly of the daybed of FIG. 1.
Figures 15, 15A:
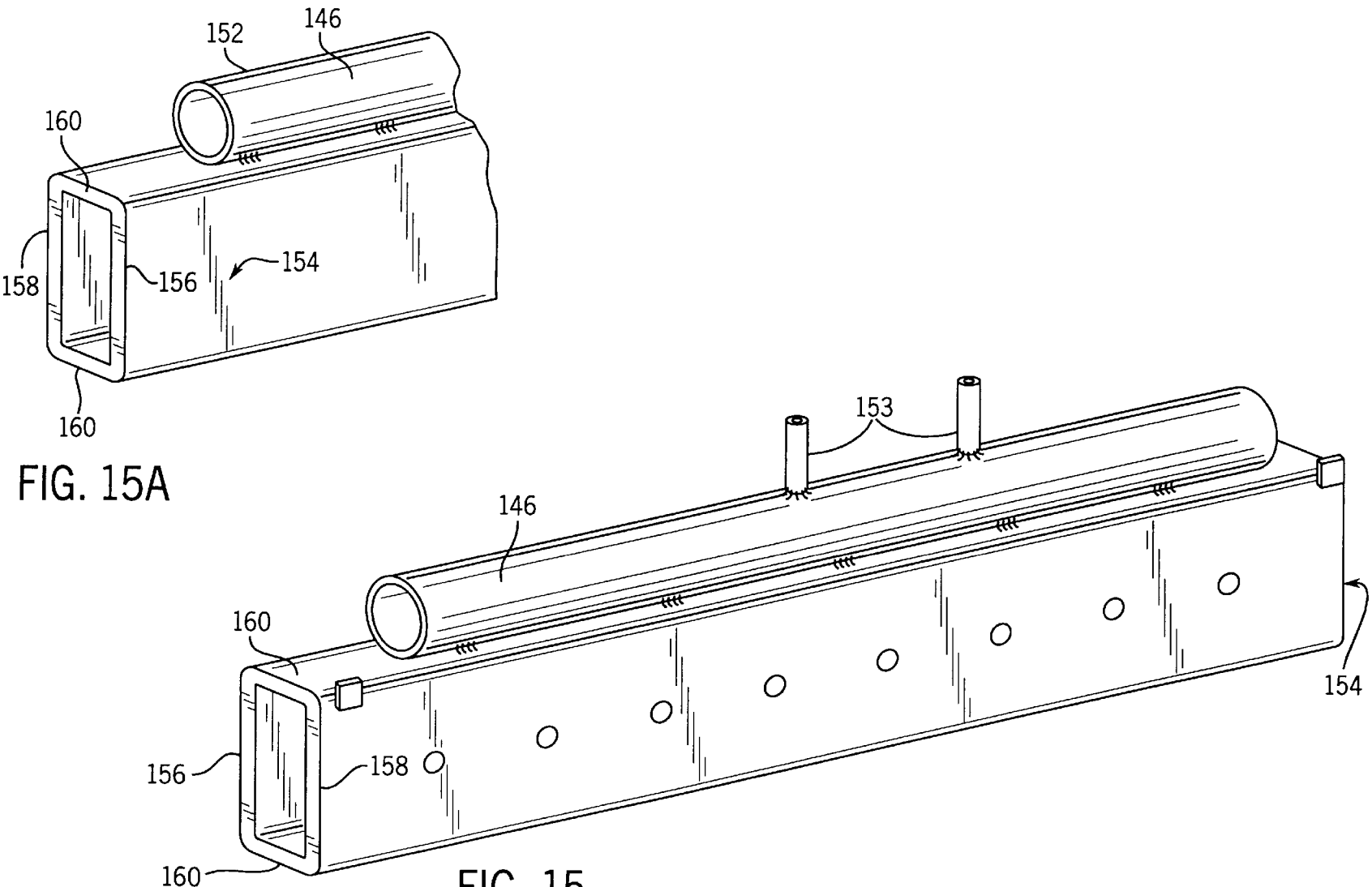
FIG. 15 is an isometric view of a portion of the interior structure incorporated into the backrest assembly of FIGS. 13 and 14.
FIG. 15A is a partial isometric view of an end portion of the backrest interior structure of FIG. 15.
Figure 15B:
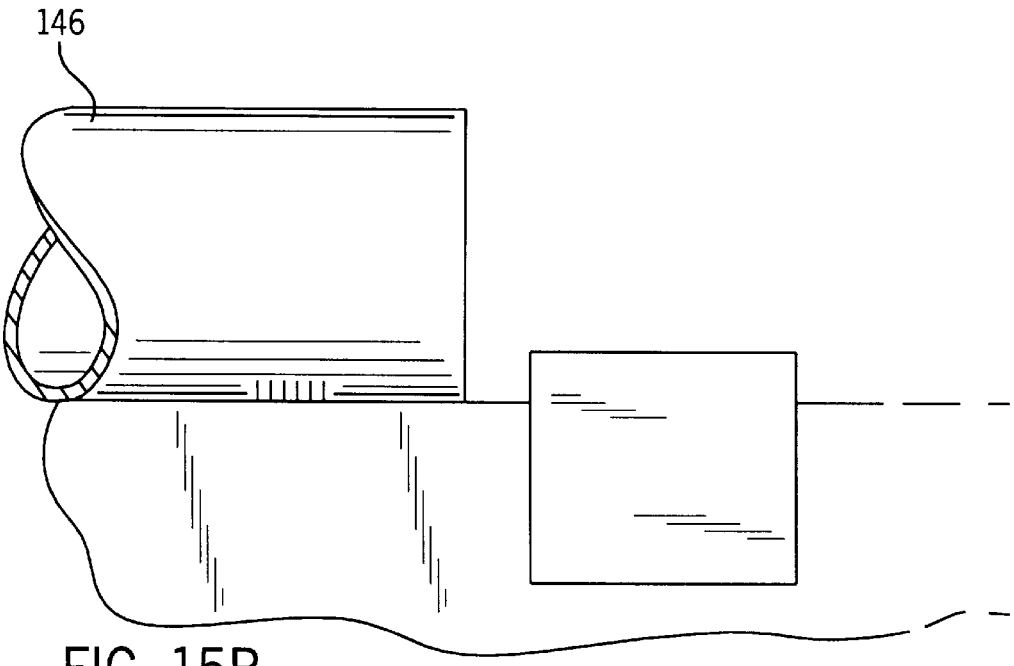
FIG. 15B is an enlarged partial rear elevation view of the end portion of the backrest interior structure of FIG. 15.
Figure 15C:
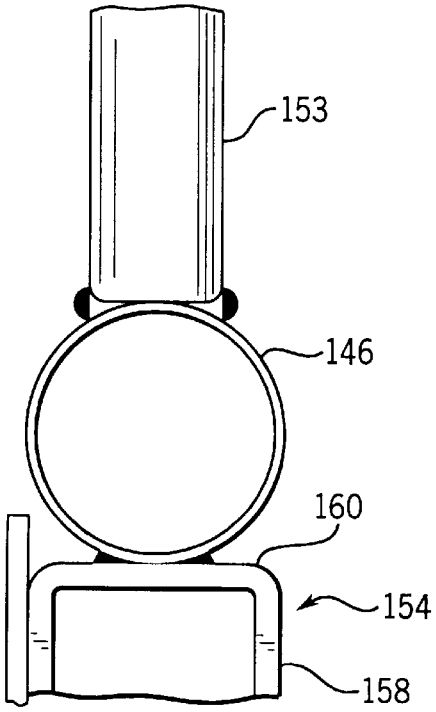
FIG. 15C is an end elevation view of the end portion of the backrest interior structure of FIG. 15B.

Referring to FIG. 14, a swivel axle receiving tube 140 is connected to the interior side of each swing arm 122 at the upper end of upper arm portion 124. Receiving tube 140 receives a swivel axle 144 and includes a first stop opening 142 that receives a stop bar 150. Swivel axle 144 extends through a backrest 145 of backrest assembly 108 and is rotatably contained within an axle housing tube 146 located within backrest 145. Swivel axle 144 also includes a second stop opening 148 that aligns with first stop opening 142 in receiving tube 140 when swivel axle 144 is inserted into receiving tube 140 so that stop bar 150 is inserted through both first stop opening 142 and second stop opening 148. A pair of stop members 152 are welded to the exterior of axle housing tube 146 at each end to limit the rotation of backrest 145 about swivel axle 144 by engaging stop bar 150 when backrest 145 reaches a certain angle of rotation relative to axle housing tube 146, thereby preventing further rotation of backrest 145. Also welded to the exterior of axle housing tube 146 within backrest 145 is a backrest beam 154, best illustrated in FIGS. 15–15A.

Backrest beam 154 is hollow and rectangular in shape and extends to within one inch of the full width of backrest 145. Beam 154 has a front surface 156, a rear surface 158 and pair of parallel side surfaces 160 forming the top and bottom of beam 154. Beam 154 is attached to axle housing tube 146 on one of the side surfaces 160 so that the front surface 156 and rear surface 158 extend perpendicularly to the axis of housing tube 146. A support board 164 is attached to rear surface 158 of beam 154 by a number of screws 166 threadably mounted to beam 154 through support board 164 and rear surface 158, securing board 164 to beam 154. Support board 164 is mounted flush with side surface 160 adjacent axle housing 146 and extends downwardly past beam 154 to a level corresponding with the lower end of backrest 145. A support member 168 is attached at the lower end of support board 164 to provide a mounting surface for VELCRO closures (not shown) located on and used to fasten an upholstered cover 171 over backrest 145. A pair of internally threaded tubes 153 are attached to housing tube 146 opposite beam 154 to facilitate the attachment of a pull handle 184 (FIG. 2) to backrest 145.

Figure 13:
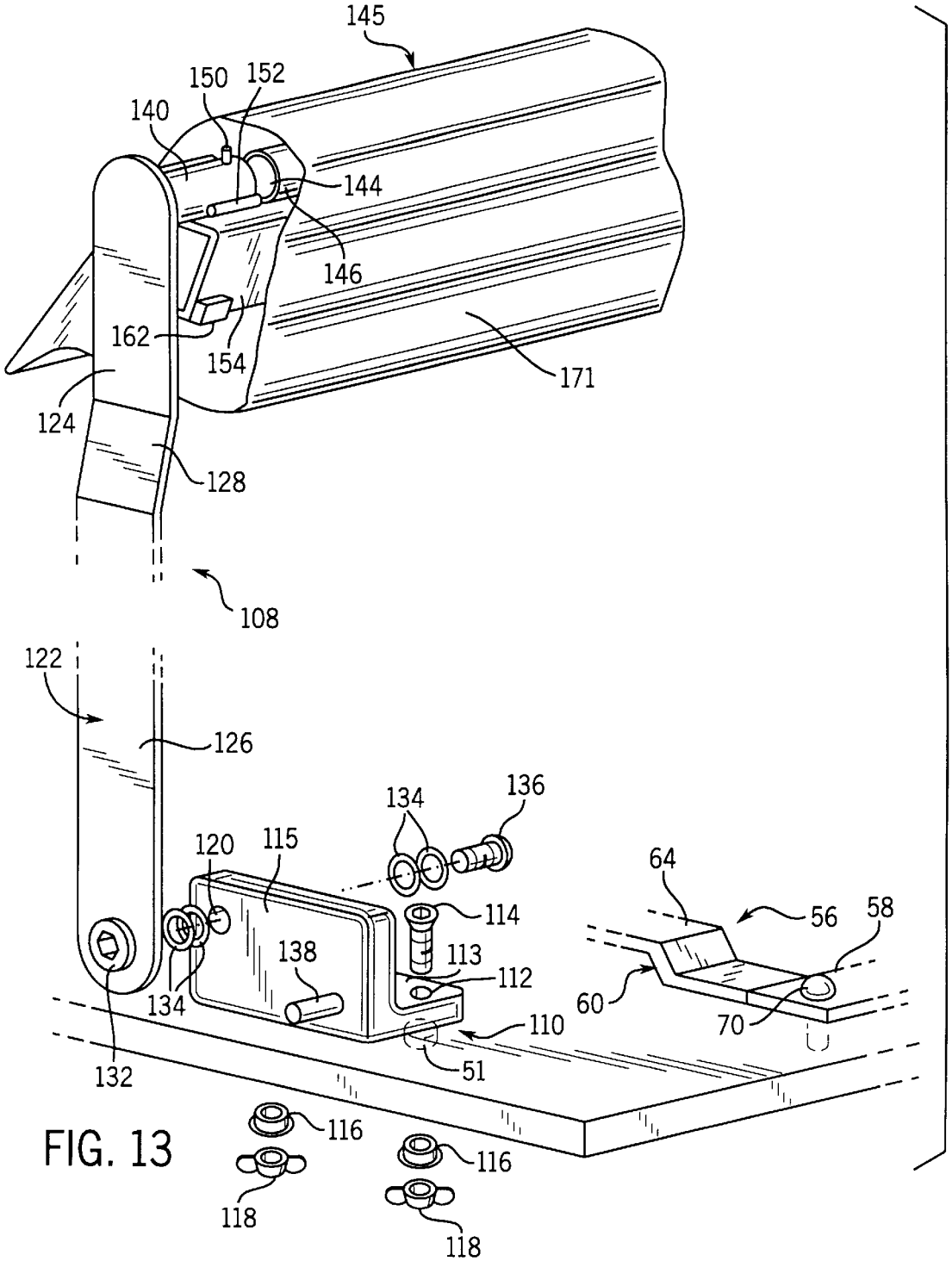
FIG. 13 is a partial exploded isometric view of the swing arm assembly of the daybed of FIG. 1.

As best shown in FIGS. 3 and 13, backrest 145 includes a foam backrest pad 170, which encloses all of the components of the backrest assembly 108, and the upholstered cover 171. The pad 170 has a convex front surface 172, a rounded top surface 174, a flat back surface 176, and a concave bottom surface 178. Back surface 176 extends below the level of front surface 172 and forms a wedge-shaped pad portion 179 that is able to engage either the front or rear rounded edge of cushions 54 to form a continuous padded surface when daybed 10 is in either the seating configuration or the sleeping configuration, as shown by FIG. 3.

In operation, daybed 10 is quickly and easily convertible from its seating configuration of FIG. 1 to its sleeping configuration of FIG. 2. To place daybed 10 in the sleeping configuration, the user grasps a pull handle strap 184 threadably engaged with threaded tubes 153, and pulls backrest assembly 108 forwardly. This causes forward pivoting movement of swing arms 122, and the user continues such movement of backrest 145 and swing arms 122 until swing arms 122 engage stop pins 138. This stops further pivoting movement of swing arms 122, and places backrest assembly 108 in its FIG. 2 position, in which the back surface 176 of backrest 145 is substantially coplanar with the top surfaces of seat cushions 54. Simultaneously, stop members 152 on axle housing tube 146 engage stop bars 150 to prevent rotation of backrest 145 about swivel axle 144. In this manner, the rotational position of swing arms 122 is fixed, as is the rotational position of backrest 145 relative to swing arms 122. Concave bottom surface 178 of backrest 145 conforms to the curvature of the front edge of cushions 54 to provide additional support for backrest 145 when pivoted forwardly. In this position, the flat back surface 176 of backrest 145 is coplanar with the horizontal upper surfaces of cushions 54 to provide a horizontal padded surface satisfactory for sleeping.

Backrest 145 also includes a zipper strip 180 (FIG. 2) and a zipper tab 182 attached to back surface 176 that are engageable with a zipper mating strip 106 attached to the end of bed cover 84 and used to removably secure bed cover 84 over the top of pad 170 and cushions 54 when daybed 10 is in the sleeping configuration of FIG. 2. In this manner, bed cover 84 is engaged with backrest assembly 108 and is rolled off of tube 88 as backrest assembly 108 is pivoted forwardly. That is, bed cover 84 is pulled from behind cushions 54 by shifting backrest assembly 108 from the seating configuration to the sleeping configuration, thereby rotating retractor mechanism 86 and allowing bed cover 84 to extend over cushions 54 when daybed 10 is in the sleeping configuration. When backrest assembly 108 is in its full forward position, bed cover 84 functions to cover the upwardly facing surfaces of seat cushions 54 and backrest 145, acting as a mattress pad and covering the openings between cushions 54 and backrest 145. When backrest assembly 108 is returned to its seating configuration as in FIG. 1, the torsional spring force exerted by rewind spring 94 functions to rewind bed cover 84 onto tube 88.

Periodically, to either wash or replace bed cover 84 as desired, bed cover 84 can be removed from backrest assembly 108 by disengaging zipper strips 106 and 180 from each other, and removing tube 88 in a manner as is known.

Bed cover 84 may be constructed of any type of sheet material. Typically, cushions 54 and backrest 145 will be covered with conventional bedding such as sheets, which may be stored within storage area 19. Alternatively, bed cover 84 may be a dual-layer construction incorporating a zipper or other similar closure, to provide a sleeping bag type construction supported by cushions 54 and backrest 145. This construction eliminates the need for extra bedding and provides a ready-to-use sleeping arrangement when daybed 10 is in its sleeping configuration. In this embodiment, the rolled diameter of the dual-layer material is relatively large, and cannot fit within the cushion channel 82. A rolled material housing is thus provided below deck 32, and the material passes through a gap formed in deck 32.

Figure 16:
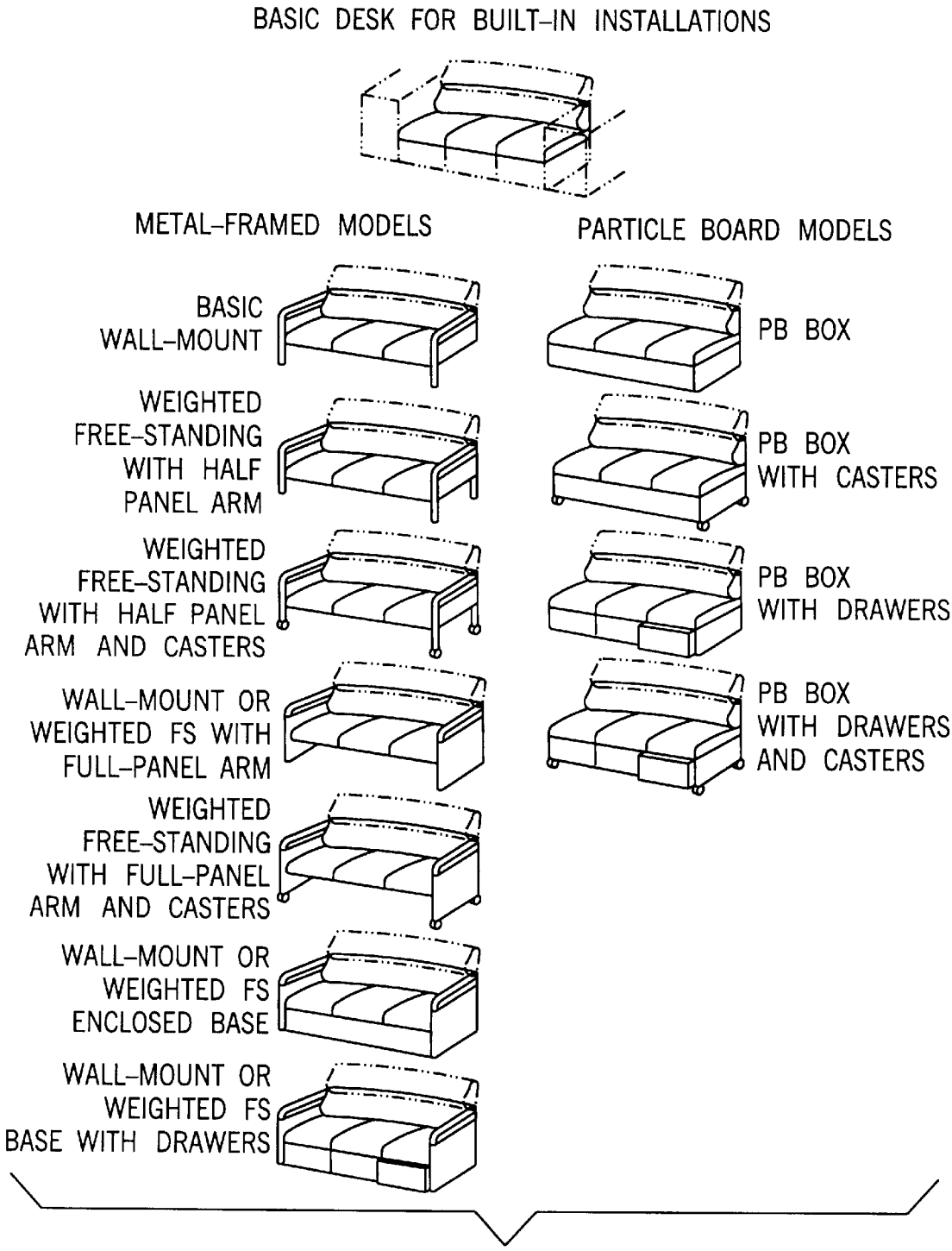
FIG. 16 illustrates various configurations available for the convertible daybed of the present invention, including a basic version for built-in installations, a wall mount version, a free-standing version with half panel arms, a free-standing version with half panel arms and casters, a wall mount or free-standing version with full panel arms, a free-standing version with full panel arms and casters, a wall mount or free-standing version with an enclosed face, a wall mount or free-standing version having a base with drawers, a particle board model incorporating a box-type pedestal, a particle board model incorporating a box-type pedestal with casters, a particle board model incorporating a box-type pedestal with drawers, and a particle board model incorporating a box-type pedestal with drawers and casters.

FIG. 16 illustrates the various available configurations for daybed 10, each of which incorporates pivotable backrest 145 for movement relative to cushions 54 as shown and described.

Backrest 145 has been shown and described as being movable relative to cushion 54 by means of pivotable swing arms 108. It should be understood, however, that any other mechanism may be employed to mount backrest 145 for movement, such as a linkage mechanism or a horizontal slide mechanism providing vertical movement of backrest 145 at the front of cushion 54.

Various alternatives and embodiments are contemplated as being within the scope of the following claims particularly pointing out and distinctly claiming the subject matter regarded as the invention.

I claim:

1. A convertible bed comprising:

a cushion assembly adapted to be secured to a support;

a backrest including a backrest cushion; and a pivotable swing arm assembly mounted between the support and the backrest that allows the backrest to be alternately positioned toward the rearward end of the cushion assembly in a seating configuration or forward of the cushion assembly in a sleeping configuration;

wherein the swing arm assembly includes a pair of swing arms, wherein each swing arm defines a first end pivotably interconnected with the support and a second end pivotably interconnected with the backrest by means of a backrest pivot arrangement, wherein the backrest pivot arrangement includes an internal backrest pivot axle disposed within the backrest and secured to the second end of the swing arm, and an internal backrest support member disposed within the backrest and pivotably mounted to the backrest pivot axle for providing pivoting movement of the backrest relative to the swing arm.

2. The convertible bed of claim 1 wherein the swing arm assembly comprises:

a pair of brackets attached to the support on either side of the cushion assembly; and wherein each swing arm is pivotably attached to one of the brackets at the first end.

3. The convertible bed of claim 2 wherein each bracket includes a lower portion secured to the support and an upper portion to which the first end of the swing arm is pivotably mounted.

4. The convertible bed of claim 1 further comprising an internal stop arrangement interposed between the internal bracket pivot axle and the internal backrest support member.

5. A convertible bed comprising:

a cushion assembly adapted to be secured to a support;

a backrest assembly; and a pivotable swing arm assembly mounted between the support and the backrest assembly that allows the backrest assembly to be alternately positioned toward the rearward end of the cushion assembly in a seating configuration or forward of the cushion assembly in a sleeping configuration, wherein the swing arm assembly comprises a pair of brackets attached to the support on either side of the cushion assembly, and a pair of swing arms each having an upper end and a lower end, wherein each swing arm is pivotably attached to one of the brackets at the lower end and to the backrest assembly at the upper end, wherein each bracket includes a lower portion secured to the support and an upper portion secured to the swing arm; and wherein the upper portion of one of the brackets includes a stop member extending from the upper portion to restrict rotation of one of the swing arms with respect to the bracket.

6. The convertible bed of claim 5 wherein the upper portion of the bracket includes a mounting opening that receives a mounting sleeve secured to the swing arm adjacent the lower end of the swing arm.

7. The convertible bed of claim 6 wherein the sleeve is held in engagement with the upper portion of the bracket by a fastener engaged with the sleeve opposite the swing arm.

8. A convertible bed comprising:

a cushion assembly adapted to be secured to a support;

a backrest assembly; and a pivotable swing arm assembly mounted between the support and the backrest assembly that allows the backrest assembly to be alternately positioned toward the rearward end of the cushion assembly in a seating configuration or forward of the cushion assembly in a sleeping configuration, wherein the swing arm assembly comprises a pair of brackets attached to the support on either side of the cushion assembly, and a pair of swing arms each having an upper end and a lower end, wherein each swing arm is pivotably attached to one of the brackets at the lower end and to the backrest assembly at the upper end, and wherein each bracket includes a lower portion secured to the support and an upper portion secured to the swing arm, and wherein each swing arm includes a tube secured on an inner surface of the swing arm adjacent the upper end that receives an axle extending from either end of the backrest assembly.

9. The convertible bed of claim 8 wherein the axle is rotatably contained within a sleeve disposed within the backrest assembly.

10. The convertible bed of claim 9 wherein the axle is secured within the tube by a stop member inserted through aligned openings in the axle and the tube.

11. The convertible bed of claim 10 wherein the sleeve includes at least one second stop member that engages the first-mentioned stop member to restrict the rotation of the backrest assembly with respect to the axle and swing arm.

12. A convertible bed comprising:

a cushion arrangement;

the backrest assembly pivotably mounted relative to the cushion arrangement for enabling the backrest assembly to be alternately positioned between a seating configuration in which the backrest assembly extends upwardly toward a rear end defined by the cushion arrangement, and a sleeping configuration in which the backrest assembly extends forwardly of a forward end defined by the cushion arrangement and in which wherein an upper surface defined by the backrest assembly is substantially coplanar with an upper surfaced defined by the cushion arrangement; and a retractable cover interconnected with the backrest assembly, wherein the cover is retracted when the backrest assembly is in the seating configuration and is extended to cover the upper surfaces of the cushion arrangement and the backrest assembly when the backrest assembly is in the sleeping configuration.

13. The convertible bed of claim 12 and further comprising a support, wherein the cushion arrangement comprises a number of individual cushions removably secured to the support and wherein the retractable cover is secured to the support.

14. The convertible bed of claim 13 wherein the backrest assembly is mounted to a swing arm assembly that comprises:

a pair of brackets secured to the support on either side of the cushion arrangement; and a pair of swing arms having an upper end and a lower end, wherein each swing arm is pivotably attached to one of the brackets at the lower end and to the backrest assembly at the upper end.

15. The convertible bed of claim 13 wherein the support comprises a top surface or frame of a pedestal.

16. The convertible bed of claim 15 wherein the support is detachable from the pedestal.

17. The convertible bed of claim 13 wherein the retractable cover comprises a rolled sheet-like member, and wherein the cushion arrangement includes a channel within which the retractable cover is located.

18. A convertible bed comprising:

a cushion assembly secured to a support and comprising a number of individual cushions removably secured to the support wherein each cushion includes a front face and a rear face, a frame, a base layer supported by the frame, at least one deformable cushion layer supported by the base layer, and a cover layer enclosing the cushion layer and secured to the base layer; and a backrest assembly pivotably mounted relative to the cushion assembly for enabling the backrest assembly to be alternately positioned between a seating configuration in which the backrest assembly is located toward a rear end of the cushion assembly and a sleeping configuration in which the backrest assembly is located forward of the cushion assembly such that upper surfaces defined by the backrest assembly and the cushion assembly are substantially coplanar;

wherein the backrest assembly is mounted to a swing arm assembly that comprises a pair of brackets attached to the support on either side of the cushion assembly and a pair of swing arms having an upper end and a lower end, wherein each swing arm is pivotably attached to one of the brackets at the lower end and to the backrest assembly at the upper end.

19. The convertible bed of claim 18 wherein the cushion assembly includes three individual cushions.

20. The convertible bed of claim 18 wherein the cushion assembly includes a number of extensions disposed along a rear face defined by the cushion assembly that are removably engageable with aligned retainers extending along a rear face defined by the support, and a number of threaded fasteners insertable into apertures spaced along a front face defined by the support.

21. A convertible bed, comprising:

a stationary cushion arrangement defining an upwardly facing surface;

a backrest assembly including a backrest cushion;

a support;

a moveable mounting assembly including a swing arm interconnected between the backrest assembly and the support for providing movement of the backrest assembly between a seating position in which the backrest cushion is located toward a first side of the upwardly facing surface defined by the cushion arrangement and extends upwardly therefrom, and a sleeping position in which the backrest cushion is positioned forwardly of a second side of the upwardly facing surface defined by the cushion arrangement, in which an upwardly facing surface defined by the backrest cushion is substantially coplanar with an upwardly facing surface defined by the cushion, wherein the backrest cushion is pivotably mounted to the swing arm; and a stationary swing arm stop associated with the support and engageable with the swing arm and a backrest cushion stop stationarily associated with the swing arm and engageable with the backrest cushion, wherein the swing arm stop and the backrest cushion stop engage the swing arm and the backrest cushion, respectively, to position the backrest assembly in the sleeping position when the swing arm attains a predetermined position relative to the support and the backrest cushion attains a predetermined position relative to the swing arm.

22. The convertible bed of claim 21 wherein the backrest cushion includes a front face, a rear face, a top surface, and a bottom surface.

23. The convertible bed of claim 22 wherein the rear face of the backrest cushion is generally flat.

24. The convertible bed of claim 23 wherein the bottom surface of the backrest cushion is concave and conforms to the shape of the first and second sides of the cushion arrangement.

25. The convertible bed of claim 24 wherein the front face of the backrest cushion is convex.

* * * * *

UNITED STATES PATENT AND TRADEMARK OFFICE

CERTIFICATE OF CORRECTION

PATENT NO. : 6,347,418 B1
DATED : February 19, 2002
INVENTOR(S) : Roger K. Leib

It is certified that error appears in the above-identified patent and that said Letters Patent is hereby corrected as shown below:

Title page,
Item [60], please insert the following:
-- Related U.S. Application Data
This application claims the benefit of provisional application No. 60/097,313, filed August 20, 1998. --

Signed and Sealed this

Twenty-fourth Day of December, 2002

JAMES E. ROGAN
*Director of the United States Patent and Trademark Office*